US012522422B1

(12) United States Patent
Habert

(10) Patent No.: US 12,522,422 B1
(45) Date of Patent: Jan. 13, 2026

(54) BRICK BUNDLE PACKAGING FOR SOCKS

(71) Applicant: HIGH POINT DESIGN LLC, New York, NY (US)

(72) Inventor: Joseph Habert, Brooklyn, NY (US)

( * ) Notice: Subject to any disclaimer, the term of this patent is extended or adjusted under 35 U.S.C. 154(b) by 0 days.

(21) Appl. No.: 17/365,576

(22) Filed: Jul. 1, 2021

Related U.S. Application Data

(60) Provisional application No. 63/047,886, filed on Jul. 2, 2020.

(51) Int. Cl.
*B65D 83/08* (2006.01)
*B65D 75/52* (2006.01)
*B65D 75/58* (2006.01)

(52) U.S. Cl.
CPC ..... *B65D 83/0805* (2013.01); *B65D 75/522* (2013.01); *B65D 75/58* (2013.01)

(58) Field of Classification Search
CPC ..... B65D 83/08; B65D 75/58; B65D 75/522
USPC ..... 206/278
See application file for complete search history.

(56) References Cited

U.S. PATENT DOCUMENTS 4,214,331 A * 7/1980 Freeze ..... D06B 5/24 8/150
4,658,995 A * 4/1987 Teague ..... D06C 5/005 223/112
4,865,205 A * 9/1989 Thorneburg ..... A47F 7/10 211/85.3
5,014,957 A * 5/1991 Nichol, Jr. ..... A47G 25/36 248/340
5,499,484 A * 3/1996 Herrin ..... B65D 5/103 53/458
6,296,144 B1 10/2001 Tanaka et al.
6,543,642 B1 * 4/2003 Milliorn ..... B65D 77/06 221/49
D721,282 S * 1/2015 Fedriani ..... D9/624
10,894,656 B2 * 1/2021 Lange ..... B65D 83/0894
2003/0057222 A1 * 3/2003 Milliorn ..... B65D 77/06 221/48

(Continued)

OTHER PUBLICATIONS

Raley's, Hanes Ankle Socks, Cushioned, Shoe Size 5-9, Images 1-5, https://www.raleys.com/product/19182192/hanes-ankle-socks-cushioned-shoe-size-5-9 ?_maxreflevel=3 2017 (Year: 2017).*

(Continued)

*Primary Examiner* — Ernesto A Grano
(74) *Attorney, Agent, or Firm* — Mandelbaum Silfin LLC

(57) ABSTRACT

A packaged bundle of socks is disclosed. The packaged bundle of socks has a package body forming a generally hexahedron shape. The package body has a fixed length, a fixed height, and a fixed width. The package body has a broad top surface having an area set by the fixed width and fixed length, the broad top surface has a reclosable opening set therein. The packaged bundle of socks also has a plurality of socks arranged within the package body. The packaged bundle of socks has a first group of the plurality of socks arranged in a first orientation with respect to the reclosable opening and a second group of the plurality of socks arranged in a second opposite orientation with respect to the reclosable opening. The plurality of socks is a predetermined number of socks and the fixed width is determined based on the predetermined number of socks.

16 Claims, 2 Drawing Sheets

(56) References Cited

U.S. PATENT DOCUMENTS

2004/0238393 A1* 12/2004 Ohi ..... A61F 13/5611 604/385.02
2005/0120463 A1* 6/2005 Cacioppo ..... A41B 11/008 2/239
2005/0263415 A1* 12/2005 Stagnitta ..... B65B 25/20 206/278
2007/0144937 A1* 6/2007 Gilroy ..... A61F 13/84 206/440
2007/0267322 A1* 11/2007 Kishida ..... A61F 13/84 206/440
2008/0037911 A1* 2/2008 Cole ..... B65D 75/5838 383/203
2008/0072248 A1* 3/2008 Sosalla ..... G06Q 30/02 725/35
2009/0297074 A1* 12/2009 Adams ..... B65D 75/585 383/208
2010/0150481 A1* 6/2010 Perell ..... B65D 75/566 283/56
2015/0238372 A1* 8/2015 Bhattacharjee ..... B65D 33/08 383/10
2016/0185508 A1* 6/2016 Tan ..... B65D 83/0805 221/45
2016/0221738 A1* 8/2016 Ball ..... B65D 75/5838
2016/0362242 A1* 12/2016 Tao ..... B65D 83/0805
2018/0229922 A1* 8/2018 Pea ..... B65B 5/06
2019/0070076 A1* 3/2019 Shinohara ..... A61K 8/0212
2019/0291942 A1* 9/2019 Lange ..... B65D 83/0805
2022/0041358 A1* 2/2022 Hebert ..... B32B 27/36
2022/0258939 A1* 8/2022 Warashina ..... B65D 83/0805
2022/0340345 A1* 10/2022 Yoshida ..... A47K 10/20

OTHER PUBLICATIONS

Kroger, Hanes(R) Comfort Blend Cushion Ankle Socks; 8 oldest product reviews, Feb. 2020-Jun. 2020; https://www.kroger.com/p/hanes-comfortblend-cushion-ankle-socks/0003825770917 (Year: 2020).*

* cited by examiner

BRICK BUNDLE PACKAGING FOR SOCKS

FIELD

This invention relates generally to a form of packaging and innovative concept for retail and online stores which sell apparel. More specifically, this invention relates to a packaging for socks in the form of a stackable or hangable brick bundle that includes an easy access opening.

BACKGROUND

Socks are conventionally offered for sale to the public at brick-and-mortar establishments and at online retail platforms. When sold in conventional stores, socks are often presented to consumers in one or multiple pairs that are bound together with a paper or cardboard belt around the body of the socks. These socks are often thrown haphazardly into a display box from which consumers select and purchase. As socks are taken and the display box is emptied by consumers, the display box is not replaced until it is empty (or nearly empty) and ready for another box of socks to take its place. Alternatively, socks are bound or attached in one or more pairs and coupled with a hook for hanging on a display to consumers. In both forms of packaging and displays for these socks, there can be a significant amount of "dead space."

In addition, conventional socks are generally regarded as reusable and non-disposable products that are intended to be worn, washed and worn again repeatedly. On the opposite end of the spectrum disposable use socks are also available to use by consumers for a one-time use. Generally, these socks are sold in a shriveled configuration which then expands to conform to the foot of a user to, for example, try on a new pair of shoes. After its intended use, the user removes the sock and disposes it. In view of the foregoing, there is a need for a convenient package for socks which allows the socks to be sufficiently sturdy to be worn, washed and worn again several times over while still being affordable enough to dispose of after even a single use.

Accordingly, given the drawbacks recited above, there is a need for an improved form of packaging for socks that enables socks to be stacked in a brick-like bundle configuration in order to eliminate dead space and allow sufficiently sturdy socks to be packaged more efficiently, and to allow the socks to be conveniently stored in places other than a sock drawer such as lockers, car trunks, etc.

BRIEF DESCRIPTION OF THE DRAWINGS

The following detailed description, given by way of example and not intended to limit the present disclosure solely thereto, will best be understood in conjunction with the accompanying drawings in which.

DETAILED DESCRIPTION

In the present disclosure, like reference numbers refer to like elements throughout the drawings, which illustrate various exemplary embodiments of the present disclosure. The advantages and features of the present disclosure will be appreciated and understood by those skilled in the art from the following detailed description.

Figure 1:
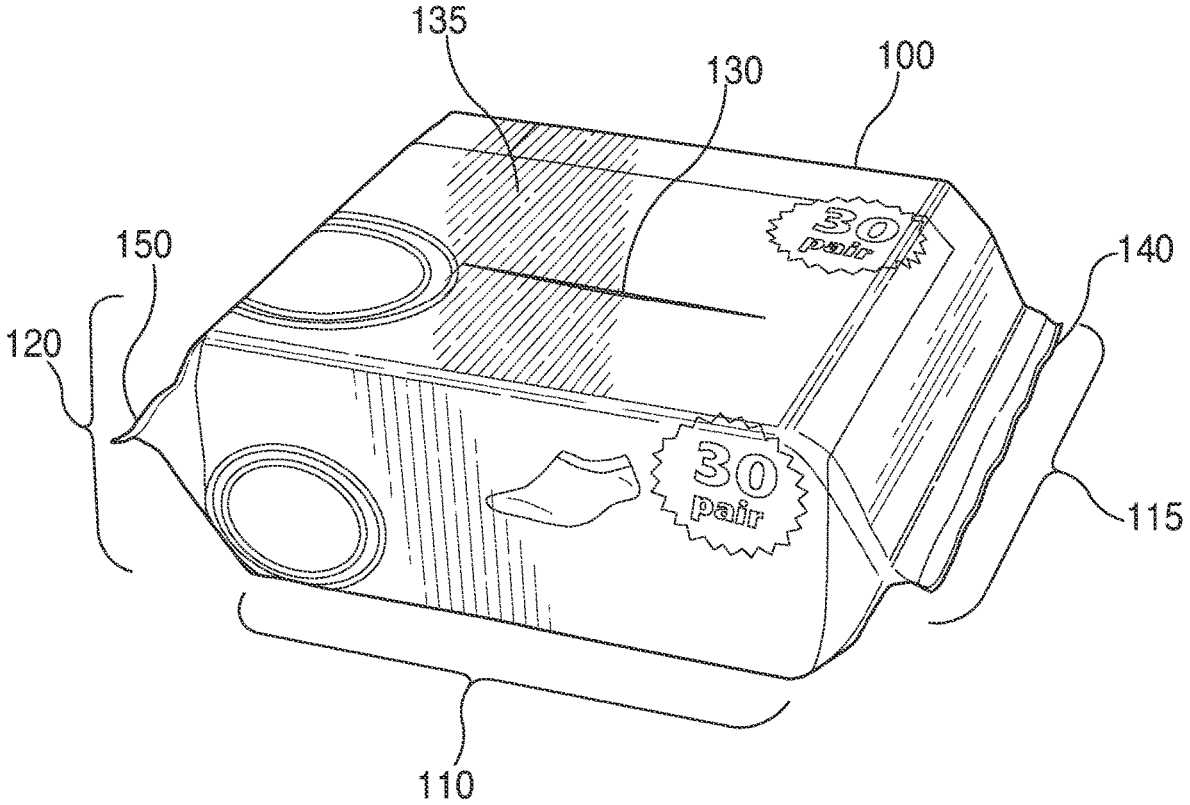
FIG. 1 is a drawing of a bundle brick package for socks according to the present disclosure.

With reference to FIG. 1, there is shown a preferred embodiment of an improved packaging for socks in the form of a brick bundle package 100 that is stackable. The brick bundle package has a generally hexahedron shape with a width 110, length 115, and height 120 (with the particular size depending on the number of socks included in the package). The brick bundle package 100 has a reclosable opening 130 in a broad top surface 135 and two sealed side panels 140, 150. In an alternative embodiment, one of the two side panels may be reclosable in order to allow re-use. The brick bundle package is sized to accommodate at least a dozen socks and preferably 12-96 socks (i.e., 1-8 dozen).

Figure 2:
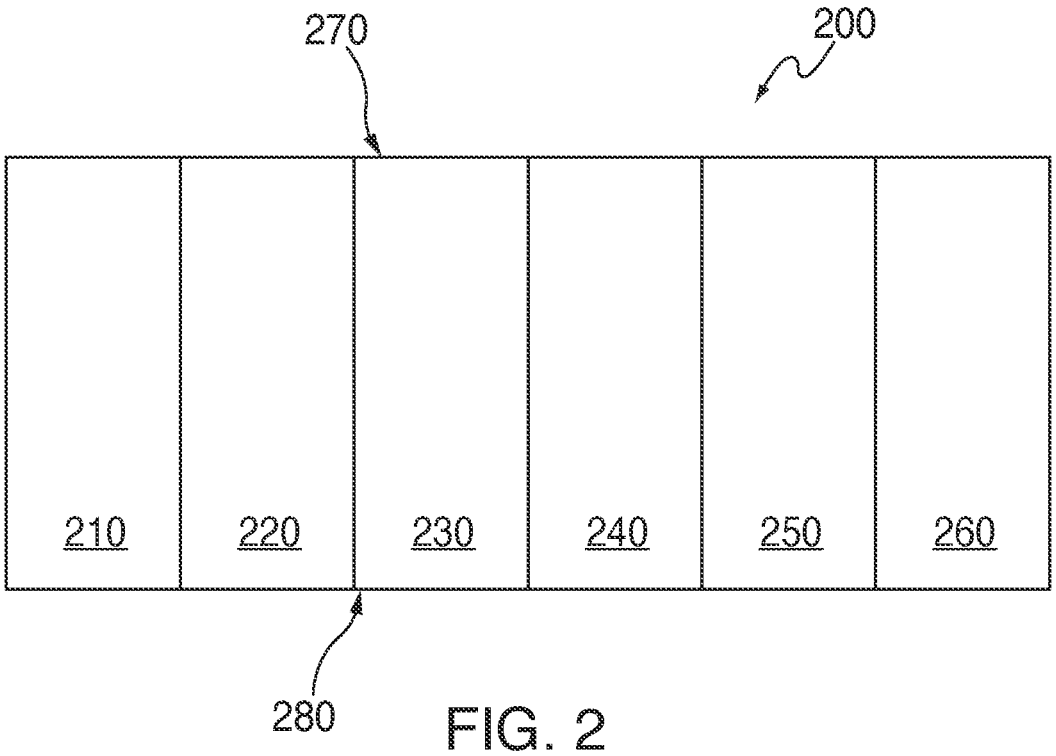
FIG. 2 is a drawing showing how the socks are arranged in the package of FIG. 1 in one example embodiment.

As shown in FIG. 2, the bundle 200 of socks includes, for example, a series of sock groups 210, 220, 230, 240, 250, 260. The number of groups depends on the total number of socks included within the bundle 200. Each sock group consists of a number of socks, e.g., 10, positioned in the same orientation. The socks are preferably oriented generally upright such that the thin ridge of the flattened socks rest upon the base or top surface of the packaging, while the broad side of the flattened socks are placed in parallel with the shorter sides of the brick bundle packaging. For some types of socks, each sock may be folded. For other types of socks, each sock is not folded. A center part of each sock is aligned close to the reclosable opening 130. The toe of the each sock in the sock groups 210, 230, 250 is positioned at one longitudinal end, e.g., end 270, of the bundle 200 and the toe of the each sock in the sock groups 220, 240, 260 is positioned at the opposite longitudinal end, e.g., end 280, of the bundle 200 in order to ensure that the socks are packed tightly together within bundle 200. In a preferred embodiment, the depth of the packaging (length 115) corresponds to the length of a sock, such that it is slightly larger than, slightly smaller than, or equal to the length of each sock. By the same token, the height of the packaging (height 120) corresponds to the height of a sock, such that it is slightly larger than, slightly smaller than, or equal to the height of each sock. This way the socks are packaged tightly into a rectangular (or squared) brick configuration or bundle, depending on the number of and size of the socks in the package. With more socks, the width 110 of the package grows, resulting in a brick bundle that is extended further, and vice versa.

For example, the following configurations are available for the preferred embodiment of 60 socks (i.e., 5 dozen) per brick bundle, in three different sizes of socks:

| Number of Socks | Size of Sock | Dimensions of Packaging |
|---|---|---|
| 60 Socks | S | 22 cm × 30 cm × 5.7 cm |
| 60 Socks | M | 24 cm × 34 cm × 5.7 cm |
| 60 Socks | L | 29 cm × 38 cm × 5.7 cm |

Given the shape of each brick bundle package 100, each brick bundle package 100 can be placed upright on one end or placed down flat for display or during shipping. The socks within the brick bundle package 100 are preferably densely and tightly packaged so that each brick bundle package 100 forms a more solid "brick" when stacked.

In a preferred embodiment, the socks are durable and may be worn daily. Currently, socks are typically found in sock draws, a hamper for dirty clothing or in the laundry. This brick bundle package 100 broadens the potential locales of socks to the lockers, gym bags, front door, cars, playrooms and many other places where users may want to keep extra pairs of socks for casual use. Socks are essentially provided with a plurality of new homes for their use.

Each brick bundle package 100 may comprise all white socks, all black socks, a combination of white, gray and black socks, or pastel colors. In instances where the color of socks is uniform, the orientation of socks within the brick bundle package 100 and the length and position of the opening thereof may not be as significant as it otherwise would be. However, in instances where there are different colors of socks within the brick bundle, the orientation of the socks within the packaging and that of the opening may be of more significance. In particular, in one embodiment, the opening of the brick bundle package 100 is elongated and preferably traverses a majority of the surface of the packaging. Preferably, the opening is also oriented transverse to the orientation of the socks within such that a user may view all or most of the socks within the package prior to selection. Then, the user may select from the different colors or versions of socks within without significantly disturbing or pulling out unwanted socks. In a further embodiment, the brick bundle package 100 may comprise a clear, transparent strip or other form of window to enable a user to view the interior contents of the package.

Figure 3:
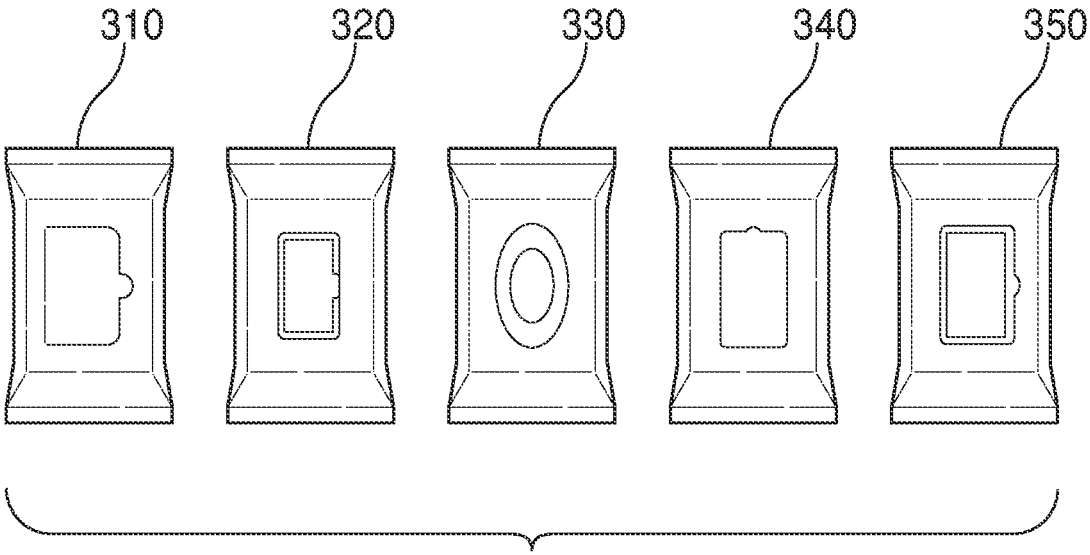
FIG. 3 is a diagram showing closure options for the package of FIG. 1.

As shown in FIG. 3, a number of different forms of closure options, openings and packaging sizes are available, including a flap 310 having an opening end arranged closer to the long side of the package, a rectangular frame-based flap 320 having a tab positioned over a slit in the package, an oval frame-based flap 330 positioned over a slit in the package, a rectangular frame-based flap 340 without a tab positioned over a slit in the package, and a flap 350 having an opening end arranged closer to the shorter side of the package. In addition to the options presented in FIG. 3, other forms of closures are available, including reclosable zipper locks that can be opened and closed as desired by a user. A key features is that, unlike prior art packaging, the opening for removing socks from the brick bundle package 100 is in the middle of the package, as shown in FIG. 1. This position, combined with the reclosable opening, allows the brick bundle package 100 to act as a long term storage place for the socks.

Although the present disclosure has been particularly shown and described with reference to the preferred embodiments and various aspects thereof, it will be appreciated by those of ordinary skill in the art that various changes and modifications may be made without departing from the spirit and scope of the disclosure. It is intended that the appended claims be interpreted as including the embodiments described herein, the alternatives mentioned above, and all equivalents thereto.

What is claimed is:

1. A packaged bundle of socks, comprising:

a package body forming a generally hexahedron shape, the package body having a fixed length, a fixed height, and a fixed width, the package body having a broad top surface having an area set by the fixed width and fixed length, the broad top surface having an opening set therein, first and second sealed side panels, and the package body having first and second longitudinal ends; and a plurality of socks arranged within the package body, each sock having one toe end, wherein the toe end of a pair of socks is positioned at the first longitudinal end and the toe end of the adjacent pair of socks is positioned at the second longitudinal end, wherein the socks are non-disposable.

2. The packaged bundle of socks of claim 1, wherein the opening is reclosable.

3. The packaged bundle of socks of claim 1, wherein the plurality of socks is a predetermined number of socks, and wherein the fixed width is determined based on the predetermined number of socks.

4. The packaged bundle of socks of claim 1, wherein each of the plurality of socks has a predetermined length, and wherein the fixed length corresponds to the predetermined length.

5. The packaged bundle of socks of claim 1, wherein each of the plurality of socks has a predetermined height, and wherein the fixed height corresponds to the predetermined height.

6. The packaged bundle of socks of claim 1, wherein the opening is elongated.

7. The packaged bundle of socks of claim 1, wherein the opening traverses a majority of the broad top surface.

8. The packaged bundle of socks of claim 1, wherein the opening is centered on the broad top surface.

9. The packaged bundle of socks of claim 1, wherein each of the plurality of socks is reusable.

10. The packaged bundle of socks of claim 1, wherein a center part of each of the plurality of socks is aligned close to the opening.

11. The packaged bundle of socks of claim 1, wherein the package body includes a clear transparent strip allowing a view of the plurality of socks within the package body.

12. The packaged bundle of socks of claim 1, wherein the plurality of socks comprises sixty (60) socks.

13. The packaged bundle of socks of claim 1, wherein the plurality of socks comprise socks of a same color.

14. The packaged bundle of socks of claim 1, wherein the plurality of socks comprise socks of having different colors.

15. The packaged bundle of socks of claim 1, wherein the package body has two sealed side panels.

16. The packaged bundle of socks of claim 1, wherein the package body has one sealed side panel and one reclosable side panel.

* * * * *